US010378322B2

(12) United States Patent
Ejim et al.

(10) Patent No.: US 10,378,322 B2
(45) Date of Patent: Aug. 13, 2019

(54) PREVENTION OF GAS ACCUMULATION ABOVE ESP INTAKE WITH INVERTED SHROUD

(71) Applicant: Saudi Arabian Oil Company, Dhahran (SA)

(72) Inventors: Chidirim Enoch Ejim, Dammam (SA); Jinjiang Xiao, Dhahran (SA); Rafael Adolfo Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 51 days.

(21) Appl. No.: 15/466,412

(22) Filed: Mar. 22, 2017

(65) Prior Publication Data

US 2018/0274344 A1 Sep. 27, 2018

(51) Int. Cl.

| | |
|---|---|
| ***E21B 43/12*** | (2006.01) |
| ***E21B 33/12*** | (2006.01) |
| ***E21B 47/00*** | (2012.01) |
| *E21B 47/06* | (2012.01) |

(52) U.S. Cl.
CPC ..... *E21B 43/128* (2013.01); *E21B 33/12* (2013.01); *E21B 47/0007* (2013.01); *E21B 47/06* (2013.01); *E21B 47/065* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,125,162 | A | 11/1978 | Groves, Sr. et al. | |
| 6,602,059 | B1 * | 8/2003 | Howell | F04B 47/06 184/6.21 |
| 7,828,059 | B2 | 11/2010 | Reid et al. | |
| 7,882,896 | B2 * | 2/2011 | Wilson | E21B 43/01 166/105.5 |
| 8,141,625 | B2 | 3/2012 | Reid | |
| 8,291,983 | B2 | 10/2012 | Rooks | |
| 8,448,699 | B2 | 5/2013 | Camilleri et al. | |
| 8,571,798 | B2 * | 10/2013 | Atherton | E21B 43/128 417/44.11 |
| 2009/0056939 | A1 | 3/2009 | Hackworth et al. | |
| 2009/0065202 | A1 * | 3/2009 | Brown | E21B 43/128 166/267 |
| 2016/0130923 | A1 | 5/2016 | Nowitzki et al. | |
| 2016/0222770 | A1 | 8/2016 | Kirk et al. | |

* cited by examiner

*Primary Examiner* — Taras P Bemko
*Assistant Examiner* — Ronald R Runyan
(74) *Attorney, Agent, or Firm* — Bracewell LLP; Constance G. Rhebergen; Linda L. Morgan

(57) ABSTRACT

A system for producing hydrocarbons from a subterranean well includes an electrical submersible pump assembly with a pump, intake, protector, and motor. A production tubing is in fluid communication with the electrical submersible pump assembly and has an inner bore sized to deliver well fluids containing both gases and liquids from the electrical submersible pump assembly to a wellhead assembly. A packer assembly circumscribes the production tubing downstream of the electrical submersible pump assembly. An inverted shroud has a closed end located between the intake and the protector and an opposite open end that is open towards the packer assembly.

14 Claims, 2 Drawing Sheets

PREVENTION OF GAS ACCUMULATION ABOVE ESP INTAKE WITH INVERTED SHROUD

BACKGROUND OF THE DISCLOSURE

1. Field of the Disclosure

The disclosure relates generally to electrical submersible pumps and in particular, to electrical submersible pump assemblies that reduce gas accumulation above fluid intakes.

2. Description of the Related Art

One method of producing hydrocarbon fluid from a well bore that lacks sufficient internal pressure for natural production is to utilize an artificial lift method such as an electrical submersible pump (ESP). A string of tubing or pipe known as a production string suspends the submersible pumping device near the bottom of the well bore proximate to the producing formation. The submersible pumping device is operable to retrieve production zone fluid, impart a higher pressure to the fluid and discharge the pressurized production zone fluid into production tubing. Pressurized well bore fluid rises towards the surface motivated by difference in pressure. Electrical submersible pumps can be useful, for example, in high gas/oil ratio operations and in aged fields where there is a loss of energy and the hydrocarbons can no longer reach the surface naturally.

Some current electrical submersible pumps are supported by cables or tubing within the well and the production fluids are produced to a wellhead at the surface through the annular space between an outer diameter of the cables or tubing and an inner diameter of an outer tubular member, which can be known as the tubing casing annulus. The outer tubular member can be, for example, well casing or other large diameter well tubing. However, in order to protect the integrity of the outer tubular member, for example to prevent corrosive gases or other fluids from contacting the inner surfaces of the outer tubular member, it can be preferable for production fluids to instead be produced to the surface through a production tubular. In addition, some regulations may restrict the use of the tubing casing annulus for the delivery of production fluids to the surface.

In some current electrical submersible pump assemblies that produce fluids through production tubing, a packer can be set a couple hundred feet above the electrical submersible pump assembly discharge. In such designs, the electric power cable from the surface is connected to the packer via a packer penetrator at the top side of the packer. The motor lead extension from the motor downhole is connected to a packer penetrator at the bottom side of the packer. These connections provide a continuous line for the electrical power required by the downhole motor to drive the rotating components of the electrical submersible pump assembly. However, the accumulation of gas below the packer can be detrimental to the electrical connectors, for example with corrosive gases such as $H_2S$. The exposure to these gases often results in failures at the packer penetrator, cable splices or the motor lead extension that are located at the packer. This is a particular concern, for example, in operations, where production is required such that the flowing bottomhole pressure falls below the bubble point pressure and free gas is formed due to dissolved gas in the liquid (such as oil or water) breaking out. Due to the lower density of the free gas compared to the liquid, the gas pockets rise above the intake and are trapped just under the packer. If the amount of free gas causes the gas column to reach the intake, the efficiency of the pump can be significantly reduced. If the gas completely fills the impeller passages, the pump can become gas locked and fail.

A current proposed solution to such problems has been the use of a shrouded electrical submersible pump system where the intake, protector, and motor are placed within a pod system and connected to a stinger. The stinger latches into a packer situated below the pod system. Well fluid from the reservoir enters the stinger and pod system and flows to the top of the pod system, where the intake is located. The fluid enters the pump and is pumped to the surface per conventional methods. However, such systems require new specialized components such as a pod, shroud hanger, stinger, and others, that need to be incorporated into the equipment assembly. These additional specialized components increase the overall cost of the assembly. Furthermore, in using a pod system, the fluid velocity at entry into the stinger increases due to the relatively smaller cross-sectional area compared to the tubing casing annulus. The higher fluid velocity reduces the pressure at this location. This additional pressure loss can trigger additional gas breakout within the pod system.

SUMMARY OF THE DISCLOSURE

Embodiments disclosed herein provide systems and methods for providing an inverted shroud to keep gas moving with well fluids so that an electrical submersible pump assembly can lift the combined gas and liquid mixture to the surface within a production tubing. This configuration reduces or eliminates pump gas lock as a result of free gas and also reduces or prevents electrical failures related to corrosive gas attacks on cables and connectors.

In an embodiment of this application, a system for producing hydrocarbons from a subterranean well includes an electrical submersible pump assembly with a pump, an intake, a protector, and a motor. Production tubing is in fluid communication with the electrical submersible pump assembly and has an inner bore sized to deliver well fluids containing both gases and liquids from the electrical submersible pump assembly to a wellhead assembly. A packer assembly circumscribes the production tubing downstream of the electrical submersible pump assembly. An inverted shroud has a closed end located between the intake and the protector and an opposite open end that is open towards the packer assembly.

In alternate embodiments, the pump can be adjacent to the intake, the intake can be located between the pump and the protector, the protector can be located between the intake and the motor, and the motor can be located further within the subterranean well than the pump. The electrical pump assembly can further include a monitoring sub, the monitoring sub being located at a lower end of the motor. The electrical submersible pump assembly can be suspended from, and supported by, the production tubing. The packer assembly can be spaced apart from the inverted shroud a distance that provides for a mixing of gases and liquids of the well fluids. The motor can be located downstream of perforations through an outer tubular member so that fluids flowing through the perforations pass the motor before entering the intake.

In an alternate embodiment of this disclosure, a system for producing hydrocarbons from a subterranean well includes an electrical submersible pump assembly with a pump, an intake, a protector, and a motor, wherein the pump is adjacent to the intake, the intake is located between the pump and the protector, the protector is located between the intake and the motor, and the motor is located further within the subterranean well than the pump, and wherein the pump is operable to lift a combined gas and liquid mixture. Production tubing suspends the electrical submersible pump assembly within the subterranean well and has an inner bore sized to deliver the combined gas and liquid mixture to a wellhead assembly. A packer assembly circumscribes the production tubing downstream of the electrical submersible pump assembly. An inverted shroud has a closed end located between the intake and the protector and an opposite open end that is open towards the packer assembly. The inverted shroud is spaced from the packer assembly a distance to allow mixing of the combined gas and liquid mixture between the packer assembly and the inverted shroud before the combined gas and liquid mixture enters the inverted shroud.

In alternate embodiments, the motor can be located downstream of perforations through an outer tubular member so that fluids flowing through the perforations pass the motor before entering the intake. The electrical pump assembly can further include a monitoring sub, the monitoring sub being located at a lower end of the motor. The open end of the inverted shroud can be spaced from the packer assembly a distance to allow mixing of the gas and liquid well fluids. A bottom of the packer assembly can be free of accumulated gas.

In another alternate embodiment of this disclosure, a method for producing hydrocarbons from a subterranean well includes providing an electrical submersible pump assembly with a pump, an intake, a protector, and a motor. Fluid communication is provided between a production tubing and the electrical submersible pump assembly, the production tubing delivering well fluids containing both gases and liquids from the electrical submersible pump assembly to a wellhead assembly through an inner bore of the production tubing. The production tubing is circumscribed with a packer assembly downstream of the electrical submersible pump assembly. A closed end of an inverted shroud is located between the intake and the protector, the inverted shroud having an opposite open end that is open towards the packer assembly.

In alternate embodiments, the pump can be adjacent to the intake, the intake can be located between the pump and the protector, the protector can be located between the intake and the motor, and the motor can be located further within the subterranean well than the pump. The electrical submersible pump assembly can be suspended from, and supported by, the production tubing. The packer assembly can be spaced apart from the inverted shroud a distance that provides for a mixing of gases and liquids of the well fluids. The motor can be located downstream of perforations through an outer tubular member so that fluids flowing through the perforations pass the motor before entering the intake. The well fluids can include a combined gas and liquid mixture and the pump can provide artificial lift to the combined gas and liquid mixture.

In other alternate embodiments, fluids flowing through the perforations can travel towards the wellhead assembly and change direction and travel away from the wellhead assembly before entering the intake and being produced through the production tubing to the wellhead assembly. The open end of the inverted shroud can be spaced a distance from the packer assembly to allow mixing of the gas and liquid well fluids. A bottom of the packer assembly can remain free of accumulated gas.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
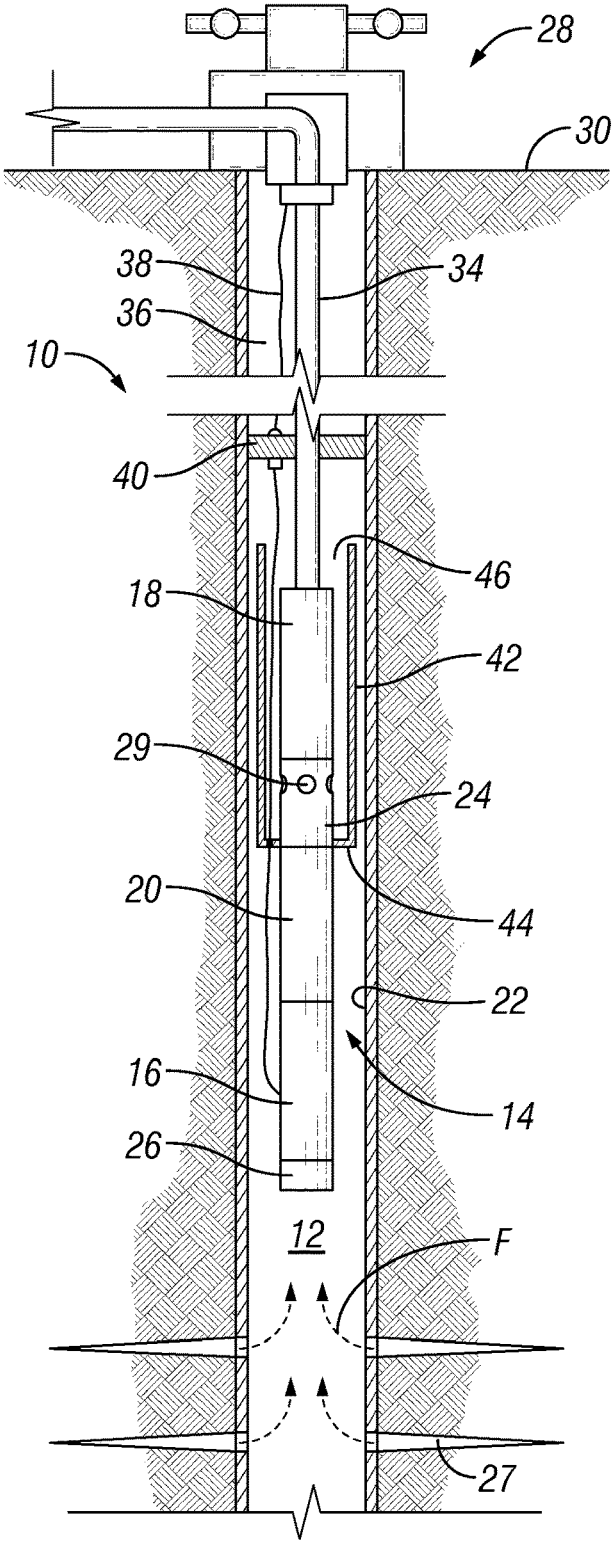
FIG. 1 is a section view of a subterranean well having an electrical submersible pump assembly, in accordance with an embodiment of this disclosure.

Looking at FIG. 1, a system for producing hydrocarbons from subterranean well 10 is shown. Subterranean well 10 includes wellbore 12. Electrical submersible pump assembly 14 is located within wellbore 12. Wellbore 12 can include outer tubular member 22, which can be, for example, a well casing or other large diameter well tubing. Electrical submersible pump assembly 14 of FIG. 1 includes motor 16 at or near the lowermost end of electrical submersible pump assembly 14. Motor 16 is used to drive a pump 18 at an upper portion of electrical submersible pump assembly 14.

Between motor 16 and pump 18 is protector 20 and intake 24. Protector 20 can be used for equalizing pressure within electrical submersible pump assembly 14 with that of wellbore 12, for providing a seal between intake 24 and motor 16, for containing an oil reservoir for motor 16, and for helping to convey the thrust load of pump 18.

A monitoring sub such as sensor 26 can be included in electrical submersible pump assembly 14 as an optional element. In the example embodiment of FIG. 1, sensor 26 is located at a lower end of motor 16. Sensor 26 can gather and provide data relating to operations of electrical submersible pump assembly 14 and conditions within wellbore 12. As an example, sensor 26 can monitor and report pump 18 intake pressure and temperature, pump 18 discharge pressure and temperature, motor 16 oil and motor 16 winding temperature, vibration of electrical submersible pump assembly 14 in multiple axis, and any leakage current of motor 16 of electrical submersible pump assembly 14.

In embodiments of this disclosure, pump 18 is adjacent to intake 24, intake 24 is located between pump 18 and protector 20, protector 20 is located between intake 24 and motor 16, and motor 16 is located further within subterranean well 10 than pump 18. Therefore, from top to bottom the elements are ordered: pump 18, intake 24, protector 20, and motor 16.

Well fluid F is shown entering wellbore 12 from a formation adjacent wellbore 12 through perforations 27. Well fluid F for production flows to opening 29 of intake 24. Because the cross sectional area through which well fluid F travels from perforations 27 to intake 24 is not reduced to a small diameter bore, the fluid velocity is not significantly increased and the pressure of well fluid F is not significantly decreased and the potential for gas breakout is lower than systems that utilize, for example, stingers upstream of intake 24.

Well fluid F is pressurized by pump 18 and travels up to wellhead assembly 28 at surface 30 through production tubing 34. Production tubing 34 is in fluid communication with electrical submersible pump assembly 14 and has an inner bore sized to deliver well fluids F from electrical submersible pump assembly 14 to wellhead assembly 28. Electrical submersible pump assembly 14 is positioned within wellbore 12 so that motor 16 is located downstream, or up-hole, of perforations 27 through the outer tubular member 22 so that well fluids F flowing through perforations 27 pass motor 16 before entering intake 24. This helps to cool motor 16 with well fluid F.

Electrical submersible pump assembly 14 is suspended from, and supported by, production tubing 34. Production tubing 34 is an elongated tubular member that extends within subterranean well 10. Production tubing 34 can be formed of carbon steel material, carbon fiber tube, or other types of corrosion resistance alloys or coatings.

Well fluids F can contain both gases and liquids as it enters intake 24 and both the gases and liquids can be produced to wellhead assembly 28 through production tubing 34 as a combined production fluid. Pump 18 is operable to provide artificial lift to well fluids F that contain a combined gas and liquid mixture and production tubing 34 has an inner bore sized to deliver the combined gas and liquid mixture to wellhead assembly 28.

Because well fluid F is produced through production tubing 34, there is no outlet releasing fluids within electrical submersible pump assembly 14 back into wellbore 12 and well fluids F are not produced through the tubing casing annulus 36. Tubing casing annulus 36 is an annular space located between an outer diameter of production tubing 34 and an inner diameter of outer tubular member 22.

Power cable 38 extends through wellbore 12 alongside production tubing 34. Power cable 38 can provide the power required to operate motor 16 of electrical submersible pump assembly 14. Power cable 38 extends to packer assembly 40 and can be connected to packer assembly 40 with a packer penetrator at the top side of packer assembly 40. Power cable 38 can then extend between packer assembly 40 and motor 16 with a motor lead extension. The motor lead extension can be connected to a packer penetrator at the bottom side of packer assembly 40. Power cable 38 can be a suitable power cable for powering an electrical submersible pump assembly 14, known to those with skill in the art.

Figure 2:
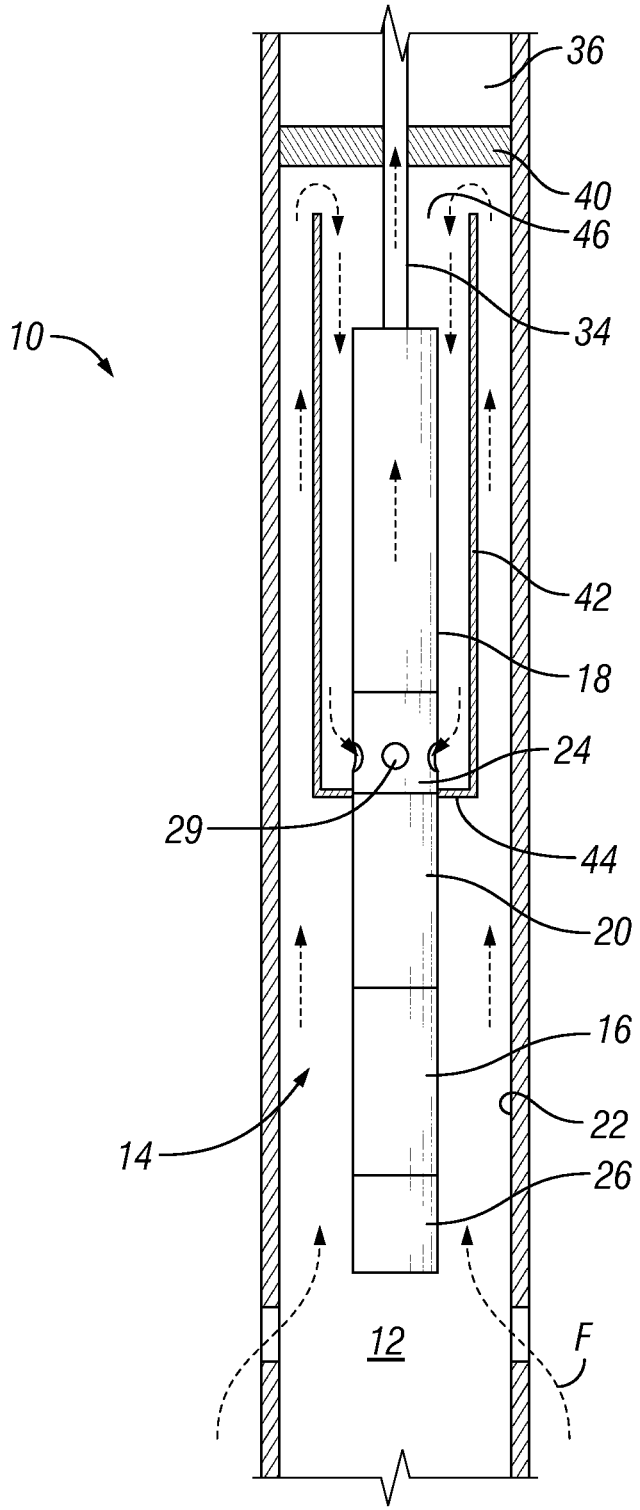
FIG. 2 is a section view of an electrical submersible pump assembly, in accordance with an embodiment of this disclosure.

Looking at FIGS. 1 and 2, packer assembly 40 circumscribes production tubing 34 downstream of electrical submersible pump assembly 14. Packer assembly 40 can be in a contracted position when lowering packer assembly 40 into wellbore 12. In the contracted position, an outer diameter of packer assembly is spaced apart from the inner diameter of outer tubular member 22. Packer assembly 40 is moveable to an expanded position so that the outer diameter of packer assembly 40 is in sealing engagement with the inner diameter of outer tubular member 22. A sealing element of packer assembly 40 can be a traditional packer member known in the art and set in a typical way. Packer assembly 40 is retrievable with electrical submersible pump assembly 14 so that as electrical submersible pump assembly 14 is pulled out of subterranean well 10 with production tubing 34, packer assembly 40 will remain secured to electrical submersible pump assembly 14. Packer assembly 40 can be designed to contain the pressures of wellbore 12 so that packer assembly 40 is a high pressure mechanical barrier.

Inverted shroud 42 is a generally tubular member that has closed end 44 located between intake 24 and protector 20. Closed end 44 circumscribes electrical submersible pump assembly 14 and prevents well fluid F from entering within inverted shroud 42 at closed end 44. An opposite open end 46 of inverted shroud 42 is open towards packer assembly 40. Fluids flowing through perforations 27 therefore travel in a direction towards wellhead assembly 28 (FIG. 1). Due to the presence of inverted shroud 42, well fluid F continues upwards past motor 16 towards packer assembly 40. Well fluid F then changes direction and travels away from the wellhead assembly 28 before entering the intake 24 and being produced through production tubing 34 to wellhead assembly 28.

Well fluid F flowing up wellbore 12 is therefore made to go through a 180° turn towards intake 24. Due to this turn and the interaction and mixing of well fluids F at and below a bottom surface of packer assembly 40, any gas pockets keep moving with well fluids F and accumulation of gas under the packer assembly 40 is prevented. If any gases do separate from liquid and begin to gather at the bottom surface of packer assembly 40, eddies and current of well fluid F will cause such gases to be carried with well fluid F into intake 24. Therefore the bottom of packer assembly 40 remains free of accumulated gas. The liquid and gas components of well fluid F are well mixed therefore the liquid phase carries the gas pockets into the intake 24 and pump 18 pressurizes and pumps the combined gas and liquid mixture to the surface as in a conventional method.

Packer assembly 40 is spaced apart from inverted shroud 42 a distance that provides for a mixing of the gases and liquids of well fluids F. Mixing of the combined gas and liquid mixture occurs between packer assembly 40 and inverted shroud 42 before the combined gas and liquid mixture enters inverted shroud 42. As an example, the open end 46 of inverted shroud 42 can be spaced from packer assembly 40 to allow mixing of the gas and liquid in the well fluid mixture. In an alternate example, the open end 46 of inverted shroud 42 can be spaced a distance from packer assembly 40 to allow mixing of the gas and liquid well fluids.

In an example of operation, production tubing 34 can support electrical submersible pump assembly 14 and be used to lower electrical submersible pump assembly 14 into wellbore 12. Electrical submersible pump assembly 14 can be lowered into subterranean well 10 to a final position where motor 16 is downstream of perforations 27 (FIG. 1) through outer tubular member 22. Packer assembly 40 can be moved in a traditional manner to an expanded position so that an outer diameter of packer assembly 40 is in sealing engagement with an inner diameter of outer tubular member 22.

Fluids flowing through perforations 27 travel in a direction towards wellhead assembly 28, continue upwards past motor 16 towards packer assembly 40, and go through a 180° turn into open end 46 of inverted shroud 42 towards intake 24. Gas keeps moving with well fluids F and pump 18 pressurizes and pumps the combined gas and liquid mixture to the surface as in a conventional method. If electrical submersible pump assembly 14 has to be pulled out for any reason, electrical submersible pump assembly 14 can be retrieved safely with production tubing 34.

Therefore, as disclosed herein, embodiments of the systems and methods of this disclosure will prevent the accumulation of gas at a bottom side of packer assembly 40. The free gas is instead kept mixed with the liquid components of well fluid F, reducing the degradation of electrical and mechanical components in the region of packer assembly 40, and increasing the reliability of electrical submersible pump assembly 14. Systems and methods of this disclosure can be utilized with currently available electrical submersible pump assembly 14 components and can reduce the overall life cycle costs of the electrical submersible pump assembly 14 and prevent deferred production costs.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for producing hydrocarbons from a subterranean well, the system including:

an electrical submersible pump assembly with a pump, an intake, a protector, and a motor;

production tubing in fluid communication with the electrical submersible pump assembly and having an inner bore sized to deliver well fluids containing both gases and liquids from the electrical submersible pump assembly to a wellhead assembly;

a packer assembly circumscribing the production tubing downstream of the electrical submersible pump assembly; and an inverted shroud, the inverted shroud having a closed end located between the intake and the protector and an opposite open end that is open towards the packer assembly; where the packer assembly is located uphole of the open end of the inverted shroud at a distance operable to cause a mixing of a gas pocket with the well fluids to form a combined gas and liquid mixture and to direct the combined gas and liquid mixture in a direction towards the intake.

2. The system of claim 1, wherein the pump is adjacent to the intake, the intake is located between the pump and the protector, the protector is located between the intake and the motor, and the motor is located further within the subterranean well than the pump.

3. The system of claim 1, wherein the electrical submersible pump assembly further includes a monitoring sub, the monitoring sub being located at a lower end of the motor.

4. The system of claim 1, wherein the electrical submersible pump assembly is suspended from, and supported by, the production tubing.

5. The system of claim 1, wherein the motor is located downstream of perforations through an outer tubular member so that fluids flowing through the perforations pass the motor before entering the intake.

6. A system for producing hydrocarbons from a subterranean well, the system including:

an electrical submersible pump assembly with a pump, an intake, a protector, and a motor, wherein the pump is adjacent to the intake, the intake is located between the pump and the protector, the protector is located between the intake and the motor, and the motor is located further within the subterranean well than the pump, and wherein the pump is operable to lift a combined gas and liquid mixture;

production tubing suspending the electrical submersible pump assembly within the subterranean well and having an inner bore sized to deliver the combined gas and liquid mixture to a wellhead assembly;

a packer assembly circumscribing the production tubing downstream of the electrical submersible pump assembly; and an inverted shroud, the inverted shroud having a closed end located between the intake and the protector and an opposite open end that is open towards the packer assembly, wherein the packer assembly is spaced uphole from the inverted shroud a distance operable to create mixing of a gas pocket with well fluids to form the combined gas and liquid mixture between the packer assembly and the inverted shroud before the combined gas and liquid mixture enters the inverted shroud.

7. The system of claim 6, wherein the motor is located downstream of perforations through an outer tubular member so that fluids flowing through the perforations pass the motor before entering the intake.

8. The system of claim 6, wherein the electrical submersible pump assembly further includes a monitoring sub, the monitoring sub being located at a lower end of the motor.

9. A method for producing hydrocarbons from a subterranean well, the method including:

providing an electrical submersible pump assembly with a pump, an intake, a protector, and a motor;

providing fluid communication between a production tubing and the electrical submersible pump assembly, the production tubing delivering well fluids containing both gases and liquids from the electrical submersible pump assembly to a wellhead assembly through an inner bore of the production tubing;

circumscribing the production tubing with a packer assembly downstream of the electrical submersible pump assembly; and locating a closed end of an inverted shroud between the intake and the protector, the inverted shroud having an opposite open end that is open towards the packer assembly; where the packer assembly is located uphole of the open end of the inverted shroud at a distance causing a mixing of a gas pocket with the well fluids to form a combined gas and liquid mixture and directing the combined gas and liquid mixture in a direction towards the intake.

10. The method of claim 9, wherein the pump is adjacent to the intake, the intake is located between the pump and the protector, the protector is located between the intake and the motor, and the motor is located further within the subterranean well than the pump.

11. The method of claim 9, further comprising suspending the electrical submersible pump assembly from, and supporting the electrical submersible pump assembly with, the production tubing.

12. The method of claim 9, wherein the motor is located downstream of perforations through an outer tubular member so that fluids flowing through the perforations pass the motor before entering the intake.

13. The method of claim 9, wherein the pump provides artificial lift to the combined gas and liquid mixture.

14. The method of claim 9, wherein fluids flowing through the perforations travel towards the wellhead assembly and change direction and travel away from the wellhead assembly before entering the intake and being produced through the production tubing to the wellhead assembly.

* * * * *